United States Patent [19]

Koch

[11] Patent Number: 4,997,149

[45] Date of Patent: Mar. 5, 1991

[54] PLASTIC BAG SUPPORT

[76] Inventor: Steven L. Koch, 103 N. Hwy. 101, Ste. 2001, Encinitas, Calif. 92024

[21] Appl. No.: 451,577

[22] Filed: Dec. 18, 1989

[51] Int. Cl.[5] ..... B65B 67/04

[52] U.S. Cl. ..... 248/100; 220/404; 248/301

[58] Field of Search ..... 248/95, 99, 100, 101, 248/301, 308; 220/1 T, 404; 141/314, 391

[56] References Cited

U.S. PATENT DOCUMENTS

| | | | |
|---|---|---|---|
| 3,175,793 | 3/1965 | Kennedy | 248/99 |
| 3,779,496 | 12/1973 | Welles | 248/99 |
| 4,723,740 | 2/1988 | Countermanche et al. | 248/95 |
| 4,728,070 | 3/1988 | Engelbrecht | 248/100 |
| 4,735,340 | 4/1988 | Preston | 248/99 X |
| 4,762,297 | 8/1988 | Milligan | 248/99 |
| 4,763,808 | 8/1988 | Guhl et al. | 248/100 X |
| 4,881,706 | 11/1989 | Sedlik | 248/99 |

*Primary Examiner*—Ramon O. Ramirez

*Attorney, Agent, or Firm*—Brown, Martin, Haller & McClain

[57] ABSTRACT

A plastic strip having outwardly projecting ears for hooking over and being supported on the rim of a trash container. The strip has shoulders on each end of which the strap ends of a t-shirt type plastic bag are attached, supporting the bag in the container.

13 Claims, 2 Drawing Sheets

PLASTIC BAG SUPPORT

BACKGROUND OF THE INVENTION

This invention concerns a device for supporting trash bags in trash bag containers, and particularly t-shirt grocery bags that are now used in grocery stores. Plastic bags are now widely used in trash cans, containers, and waste baskets of any size or shape. One of any of several reasons for this is that when the trash bag is in the trash container or waste basket, then all of the refuse placed in the container goes directly into the receiving plastic trash bag. The trash bag can then be easily and quickly removed from the trash container, with the trash bag being taken to the second point of disposal, without having to move or carry the trash container along to the second point of disposal, or returning the trash container back to its original location. Further the trash bags accept wet refuse such as food or the like, without wetting the inside of a waste basket. Still further, the trash container or waste basket doesn't receive trash on its surfaces, and accordingly always is maintained in a new and clean condition. Still further, it is much easier to carry the trash in a trash bag, than in a trash can. Especially, if the refuse from several trash cans are being taken to a secondary disposal point in one trip. The new t-shirt type grocery plastic bags, are particularly useful for this, because they have carrying straps which ease carrying the refuse to a secondary disposal point.

In using plastic bags for waste baskets, particularly in offices and the like, a trash bag is placed in the trash can or wastebasket with the upper end of the bag folded over the upper rim and down the outer sides of the upper end of the waste basket. While this is serviceable, it requires a relatively expensive bag to be used and also the end of a trash bag usually falls down or is pulled down into the waste basket when in use.

Accordingly there is a need for an inexpensive, serviceable, and easy to use support device for supporting plastic bags, and particularly the t-shirt type plastic bags, in trash containers. While there are some devices that are presently being used for this purpose, these devices are generally made of wire and thus are expensive and not bendable. Such devices are often limited to particular types and shapes of trash containers, and also are expensive.

SUMMARY OF THE INVENTION

This invention recognizes the problems of the prior art and the need, and provides a plastic bag support that is relatively inexpensive to make, is flexible in its use on virtually any shaped trash container, whether it has square sides, round sides or whatever, and attaches to trash containers having upper rims with different thicknesses.

An exemplary embodiment of the plastic bag support of this invention comprises a plastic strip having a length that is longer than its height and is made of relatively thin plastic material, so that it is flexible. At each end are upper shoulders or ears that project outwardly, on which a plastic bag is attached. The shoulders are particularly adapted for receiving the upper loops of t-shirt type grocery bags.

Inset into the plastic strip, such as by cutting, molding, stamping or the like, are hook members that bend outwardly to hook over the rim of a trash container. These hook members are integral with the plastic strip, and thus are resiliently biased inwardly by the deformation, memory of the plastic material. While the hook members have a sufficient size and outward displacement to fit over the upper rim portion of most trash containers, the hook members are always biased inwardly so that the hook member is pressed against the outer surface of the container, regardless of the thickness with the rim over which the hook member is fitted. Since the plastic strip is flexible, it can conform not only to the flat sided garbage can, but also to round trash containers.

It is therefore an object of this invention to provide a new and improved plastic bag support for supporting plastic bags in trash containers.

BRIEF DESCRIPTION OF THE DRAWINGS

The foregoing and other objects and many attendant advantages of this invention will become more apparent upon a reading of the following detailed description and an examination of the drawings, wherein like reference numerals designate like parts throughout and in which.

DESCRIPTION OF THE PREFERRED EMBODIMENT(S)

Figure 1:
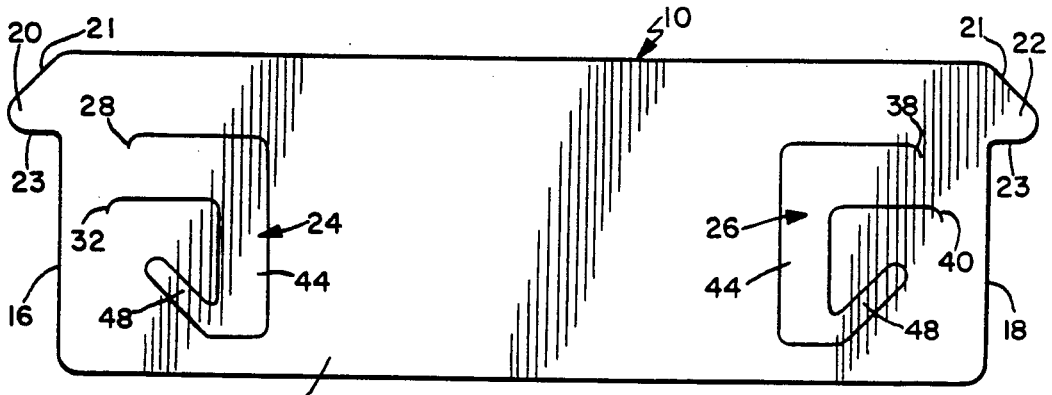
FIG. 1 is a front face view of the plastic bag holder in the flat configuration as manufactured.
Figure 2:
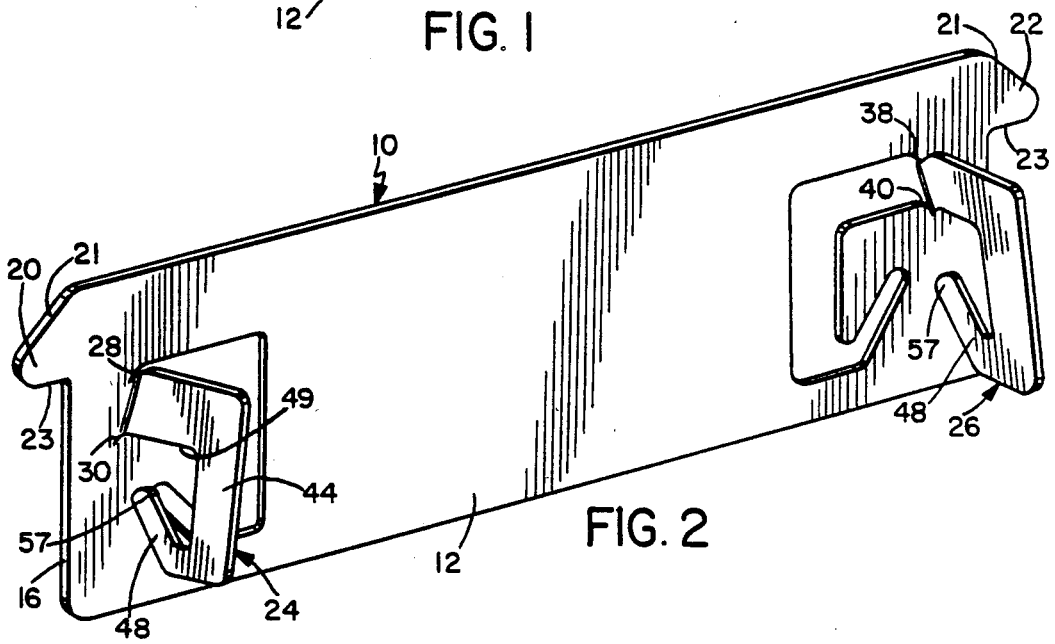
FIG. 2 is a perspective view from the rear with the retaining ears pressed out and extended.

An embodiment of the plastic bag support is illustrated in FIGS. 1 and 2. The support 10 comprises a plastic strip of relatively thin plastic material, that allows the plastic strip 12 to bend longitudinally. The thickness can be in the order of seventy five thousandths of an inch. On each end are shoulders or ears 20 and 22 that have an angled upper surface 21 for the bag to slide over easily, and a lower surface 23 that positively holds the bag in position. Ears 20 and 22 are particularly adaptable for receiving and holding the straps of a t-shirt bag. Plastic strip 10 can have any suitable length, and generally has the length of about 7 inches which is the preferred length for receiving t-shirt bags. Sides 16 and 18 can have any suitable length or height, so long as it is sufficient to provide space for the hook members 24 and 26.

Figure 5:
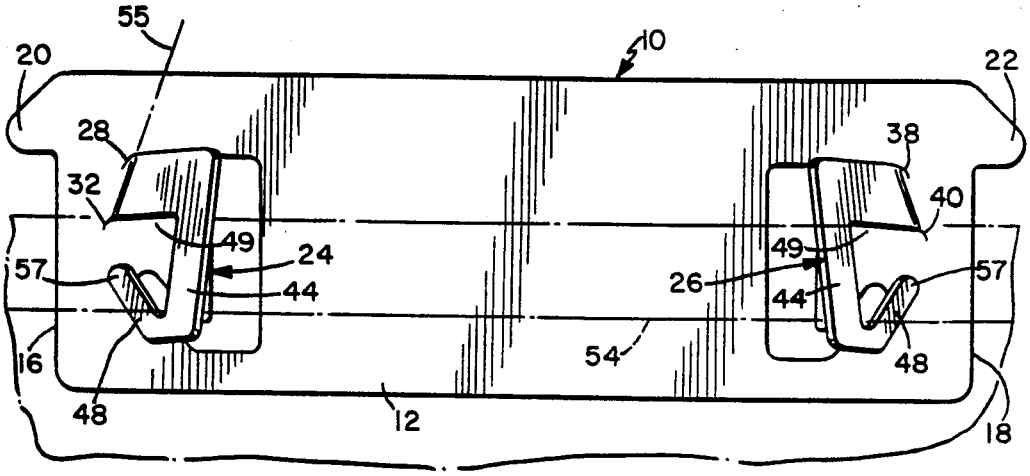
FIG. 5 is a side view of the plastic bag holder mounted on a container illustrated in phantom.
Figure 7:
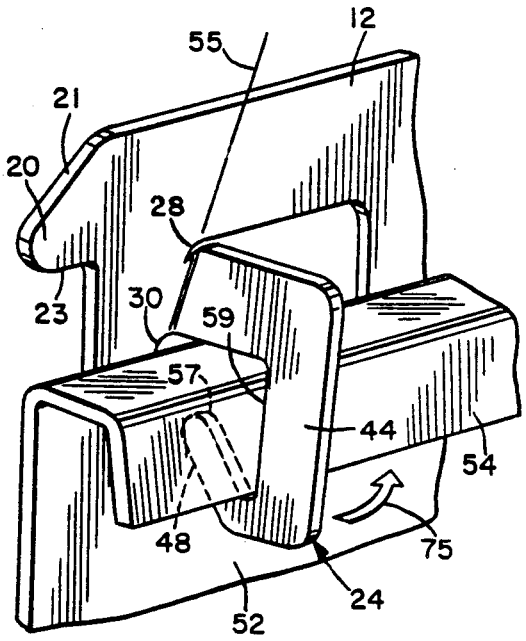
FIG. 7 is a perspective view, with parts broken away illustrating the operative forces on the holder and the hook member when positioned on a trash container.

The hook members 24 and 26 are for securing the support 10 onto the side of a trash container, and are inset into the strip 12. These hook members are made by stamp cutting or by some other suitable means. Thus the hook members 24 and 26 can be easily bent outwardly in the manner illustrated in FIG. 2. Each of the hook members has a hook portion 48 and a recessed space 49, which fits over the average sized upper rim 54 of a trash container 52, as illustrated in FIGS. 5 and 7. When the hook member 24 is bent outwardly, it is bent along line 55. The plastic material is flexible and resilient and continuously, resiliently biases the hook member to the inset position by the resiliant memory of the plastic material. It can thus be understood, that hook member 24, see FIGS. 2, 5 and 7, can be bent outwardly to provide a space 49 for the rim 54 of a trash container. Yet if rim 54 did not project outwardly as much as is illustrated in FIG. 5, then the hook member 24 would be biased inwardly so that the hook portion 48 would always be under the rim 54, even though the outward displacement of the rim 54 was greater or less. Accordingly, the hook member 24 is resiliently biased to be adaptable to mate with rims on trash containers that may have many different shapes and thicknesses.

The hook members 24 and 26 are formed by cutting through the plastic strip 12, which cuts terminate at curved ends 28, 32, 38, and 40. Each of the respective curved ends allow for relatively easy bending of the members 24 and 26 in the prescribed direction without creating shear stresses that could lead to shear cracks or an enlargement of the cuts.

Figure 4:
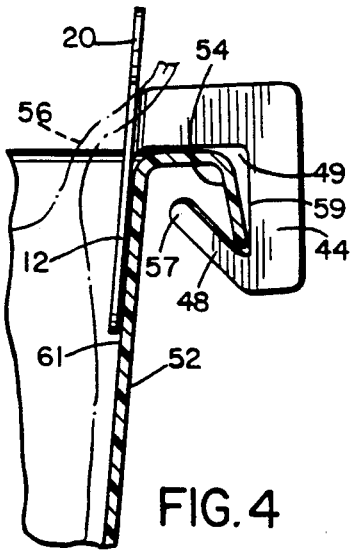
FIG. 4 is an enlarged sectional view taken on line 4—5 of FIG. 3.
Figure 6:
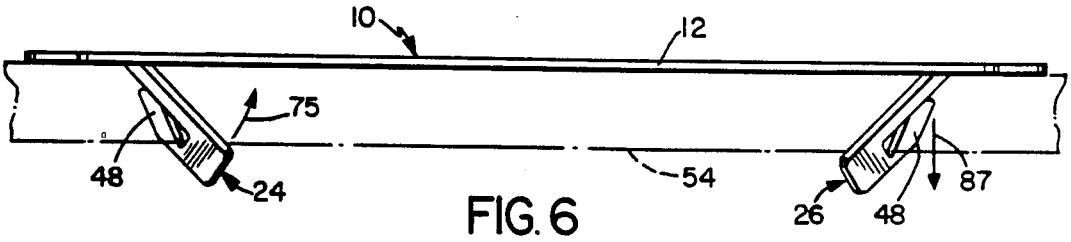
FIG. 6 is a top plan view of the holder illustrated in FIG. 5.

The curved ends 32 and 40 are spaced outwardly from curved ends 28 and 38. Accordingly when the hook members, member 26 for example, is bent outwardly, it bends along line 55. The hook member in bending along line 55 causes the portion 44 to be somewhat in alignment with line 55. This in turn causes the hook end 57 to move outwardly in the direction of arrow 87 in FIG. 6 from the side of strip 12 to a degree greater than that caused by just the outward movement of hook member 24. This twisting action provides an increasing open space between hook end 57 and the side of the strip 12, to allow the hook end 57 to fit over the outer rim 54 of the trash container 52. Since the hook member is biased in an inward direction indicated by arrow 75 in FIG. 7, it presses inward to the point that the inner edge 59, see FIG. 4 and 7, is normally forced against the outer edge surface of the upper rim 54, reducing any movement or play of support 10 on the container. This resilient force further presses support 10 against the inner surface 61 of container 52 as illustrated in FIG. 4.

The offset of ends 38 and 40 and the angled bending along line 55, causes a twisting action on hook member 24, see FIG. 7, when vertical forces are exerted on the hook in its retaining position on the container 52. This causes the hook member to try to move in a rotational direction of arrow 75 toward the strip 12, and always in an inward direction. Thus the respective hook members 24 and 26 are biased to rotated towards each other, rather than in either direction as could occur if the ends 38 and 40 were vertically aligned. This aids in making the connection between the plastic strip member and the respective container a secure attachment, and one that will support the plastic bag without excessive movement.

Figure 3:
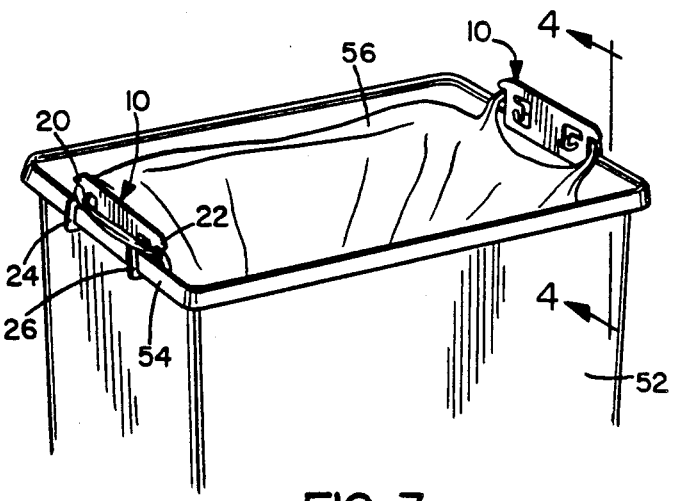
FIG. 3 illustrates the holder supporting a plastic bag in a typical flat sided trash container.
Figure 8:
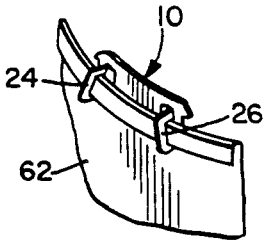
FIG. 8 illustrates a holder supporting a plastic bag in a typical round sided trash container.

In operation, the support 10 is positioned as illustrated in FIGS. 3 and 4, on the side of a trash container. The support is positioned inside the container, because the rim portion usually projects outwardly from the side of the trash container. The hook members 24 and 26 are bent outward, and fitted over the outside of the rim 54 of a trash container 52. The strap ends of a t-shirt trash or grocery bag 56 are hooked over the ears 20 and 22 and thus supported in trash container 52. FIG. 8 illustrates that the plastic strip is sufficiently flexible longitudinally to be positioned on a circular trash container 62 and, in FIG. 3, on a trash container having flat sides.

It is to be understood that support 10 only holds one side of a plastic bag and the other side of the plastic bag is supported by an identical plastic bag support. Generally only two supports are needed to support a plastic bag, and this is especially the case in supporting t-shirt type plastic bags. However, it should be recognized that multiple supports could be spaced around a large container and the plastic bag can then be hooked over several supports, at their spaced locations.

Further, the outer surface of the plastic strip 10 is usually treated with a suitable material that allows printing thereon, and instructions to use the plastic bag support along with advertisements and the like are easily stamped on the side of the support.

The resilient portion of the holder resiliently biases the hook member 24 inwardly along arrow 75, and also downwardly because of the angle of line 55, relative to vertical. This constantly resiliently biases the hook member 24 to a tightened and holding position, that provides a positive, snug, gripping of the hook portions 24 and 26 to the trash container 52.

As various changes may be made in the form, construction, and operation of the plastic bag support and parts described herein without departing from the spirit and scope of the invention, it is to be understood that all matter herein is to be interpreted as illustrative and not in any way limiting.

I claim:

1. A support for fitting onto the upper rim of a trash container comprising:

a plastic strip having an upper shoulder on each end for holding a plastic bag;

and integral hook members inset in and co-planar with said strip that are bendable outwardly to fit over the rim of a trash container holding the support and plastic bag in position on the trash container.

2. A support is claimed in claim 1 including;

means for biasing said hook members from the outwardly position towards the inset position.

3. A support as claimed in claim 2 in which;

said biasing means comprising a bendable integral connection between said hook members and said plastic strip.

4. A support as claimed in claim 3 in which;

said plastic strip being horizontal when positioned on the rim of a container that is horizontal;

said bendable integral connection being formed to bend along a given bending line;

and said bending line is at an acute angle to horizontal.

5. A support for fitting onto the upper rim of a trash container comprising:

a plastic strip having an upper shoulder on each end for holding a plastic bag;

integral hook members on said strip that are bendable outwardly to fit over the rim of a trash container holding the support and plastic bag in position on the trash container;

and said hook members comprising a first hook member at one end of said strip and a second hook member at the other end of said strip.

6. A support as claimed in claim 5 in which;

said hook members have inwardly curved, lower ends, that curve back toward the strip when projecting outwardly.

7. A support as claimed in claim 5 in which;
said hook members being cut into said plastic strip with the upper end portion being integral with the plastic strip.

8. A support as claimed in the claim 7 in which;
each of said hook members comprising an upper horizontal portion that projects outwardly and that is integral with a vertical portion, with the lower end of the vertical portion being integral with a horizontally inwardly directed portion with the end of the horizontally, inwardly directed portion having an upward projection at an acute angle.

9. A support as claimed in claim 8 in which;
said upper portion of said hook member being integrally connected with said plastic strip along a given line which line extends at a slight angle outwardly from vertical in the direction toward the end of said strip,
whereby said hook member when being bent outwardly, has its lower hook end biased inwardly against the surface and under the upper rim of the trash container.

10. A support for fitting onto the upper rim of a trash container when the upper rim projects outwardly from the outer wall of the trash container, comprising:
a plastic strip having upper ears on each end on which a plastic bag is held;
said plastic strip having integral hook members inset at opposite ends of said strip;
and said hook members being bendable outwardly to hook over the rim of the trash container, supporting a plastic bag in the trash container.

11. A support as claimed in claim 10 in which;
said hook members having upper ends integral with said plastic strip and being bendable along a line inclined towards the ends of said strip causing said hook member to be angled outwardly at its lower end over the outwardly projecting rim of the trash container.

12. A support as claimed in claim 11 in which;
said hook members being inset in said strip and being resiliently biased outwardly by the resiliant memory of the plastic strip.

13. A support as claimed in claim 12 in which;
said hook members being cut or molded in said plastic strip with the upper and lower ends of the cut defining the point of bending of the hook member outwardly;
and the upper terminal end of the cut being inward from the lower terminal end of the cut relative to the end of the strip, wherein the hook member bends inwardly toward the support when the hook member is being bent outwardly from the support.

* * * * *